US007563044B2

(12) United States Patent
Vandermeulen et al.

(10) Patent No.: US 7,563,044 B2
(45) Date of Patent: Jul. 21, 2009

(54) IDENTIFYING COMPATIBLE COMBINATION FOR A THERMAL PRINTER

(75) Inventors: Kris Vandermeulen, Bornem (BE); Jos Vleurinck, Oordegem (BE); Geert Heyse, Sint-Katelijne-Waiver (BE)

(73) Assignee: Dymo, Sint-Niklaas (BE)

( * ) Notice: Subject to any disclaimer, the term of this patent is extended or adjusted under 35 U.S.C. 154(b) by 247 days.

(21) Appl. No.: 10/540,746

(22) PCT Filed: Dec. 23, 2003

(86) PCT No.: PCT/EP03/14993

§ 371 (c)(1),
(2), (4) Date: Feb. 16, 2006

(87) PCT Pub. No.: WO2004/058507

PCT Pub. Date: Jul. 15, 2004

(65) Prior Publication Data

US 2006/0165461 A1 Jul. 27, 2006

(30) Foreign Application Priority Data

Dec. 24, 2002 (GB) ..... 0230196.8

(51) Int. Cl.

| | |
|---|---|
| ***B41J 13/00*** | (2006.01) |
| ***B41J 3/407*** | (2006.01) |
| ***B41J 35/22*** | (2006.01) |
| ***B41J 17/22*** | (2006.01) |

(52) U.S. Cl. ..... 400/578; 400/207; 400/208; 347/177; 347/214

(58) Field of Classification Search ..... 400/207–208, 400/708, 613; 347/172–173, 177, 214
See application file for complete search history.

(56) References Cited

U.S. PATENT DOCUMENTS

| | | | | |
|---|---|---|---|---|
| 4,900,171 | A * | 2/1990 | Mueller et al. | 400/208 |
| 5,366,307 | A * | 11/1994 | McGourty et al. | 400/708 |
| 5,494,365 | A | 2/1996 | Nagae et al. | |
| 5,857,788 | A | 1/1999 | Gutsell et al. | |
| 6,380,965 | B1 * | 4/2002 | Sims et al. | 347/218 |
| 6,457,885 | B1 * | 10/2002 | Yamamoto et al. | 400/207 |
| 6,802,659 | B2 * | 10/2004 | Cremon et al. | 400/76 |
| 7,051,933 | B1 * | 5/2006 | Nagaoka et al. | 235/451 |
| 2003/0123915 | A1 * | 7/2003 | Klinefelter et al. | 400/237 |

FOREIGN PATENT DOCUMENTS

| | | | |
|---|---|---|---|
| EP | 0 773 110 B1 | | 5/1997 |
| EP | 1 104 701 A2 | | 6/2001 |
| JP | 07-061009 | * | 3/1995 |

OTHER PUBLICATIONS

International Search Report, dated May 3, 2004.

* cited by examiner

*Primary Examiner*—Daniel J Colilla
*Assistant Examiner*—Marissa L Ferguson-Samreth
(74) *Attorney, Agent, or Firm*—Marshall, Gerstein & Borun LLP

(57) ABSTRACT

A printing apparatus having a first zone for receiving a supply of image receiving tape and a second zone for receiving a supply of thermal transfer ribbon, means for identifying the nature of the image receiving tape and the thermal transfer ribbon located in the first and second zones, and means for implementing a compatibility check to determine whether said image receiving tape and said thermal transfer ribbon are compatible, and to generate an incompatibility indication if the the compatibility check fails.

29 Claims, 12 Drawing Sheets

IDENTIFYING COMPATIBLE COMBINATION FOR A THERMAL PRINTER

CROSS REFERENCE TO RELATED APPLICATIONS

This is the U.S. National Stage of PCT/EP2003/014993, filed Dec. 23, 2003, which in turn claims priority to European Patent Application No. 0230196.8, filed Dec. 24, 2002, both of which are incorporated herein by reference in their entireties.

FIELD OF THE INVENTION

The present invention relates to identifying compatible combinations in a thermal printing apparatus, particularly identifying whether an inserted combination of thermal transfer ribbon and an image receiving tape are compatible.

BACKGROUND

Thermal printers are widely known and generally comprises a printing means comprising a thermally activatable printhead for printing onto an image receiving tape. Typically, the image receiving tape has an upper layer for receiving an image and a removable liner layer or backing layer secured to the upper layer by a layer of adhesive, such that after an image has been printed the liner layer or backing layer can be removed and the image receiving tape can be stuck down in the form of a label. Such thermal printers include cutters for cutting off a length of image receiving tape after the image has been printed. Such thermal printers operate with a consumable in the form of image receiving tape, or any other image receiving substrate such as heat shrink tube, magnetic, iron-on labels, plastic strips, etc. The term "consumable" is used herein to denote any appropriate form of providing image receiving tape. A number of forms of consumables are known in the art, including cassettes which comprise a housing in which is located a supply of image receiving tape. Cassettes are generally usable once only, such that once the image receiving tape has been consumed, the cassette (including the housing) is thrown away.

Another type of consumable is a holder, which comprises a spool around which image receiving tape is wound. The spool may or may not be driven, and generally comprises a plastic component.

Another type of consumable is a roll of tape without a permanent holder, for example wound on a paper core. These are termed "supplies".

In thermal printers, an image is generally generated by activation of a thermal printhead against an ink ribbon cassette, such that ink from the ink ribbon is transferred onto the image receiving tape at a print zone. So-called direct thermal tapes are also available, in which an image is created directly onto the direct thermal tape without the interposition of an ink ribbon cassette.

The following documents are mentioned by way of general background. U.S. Pat. No. 5,494,365 discloses a tape spool with a tape identification member which can be optically read, to identify the nature of the tape. EP 1104701 relates to a cassette which selectively activates mechanical plunger switches in a thermal printer depending on the size and type of tape in the cassette. In EP 1104701, thermal transfer ribbon and image receiving tape are housed in the same cassette, so the compatibility issue does not arise.

None of these prior art documents address the problem of determining whether or not a particular thermal transfer ribbon and image receiving tape are compatible in a flexible and extensible way.

European Application No. 96114988.7 relates to a system where cassettes housing an image receiving tape and cassettes housing thermal transfer ribbon have protrusions which mate or not depending on whether the particular combination of cassettes (thermal transfer ribbon and image receiving tape) is compatible or not. Moreover, a cassette holding a direct thermal tape (which does not need an ink ribbon cassette with it) has a protrusion which prevents the insertion of an ink ribbon cassette at the same time.

This system requires the use of cassettes which can mechanically cooperate when in the printer, which is restrictive in terms of the printer layout. Also, the number of combinations which can be dealt with is necessarily limited because of the mechanical nature of the cooperating protrusions.

SUMMARY OF THE INVENTION

According to one aspect of the invention there is provided a printing apparatus having a first zone for receiving a supply of image receiving tape and a second zone for receiving a supply of thermal transfer ribbon, means for identifying the nature of the image receiving tape and the thermal transfer ribbon located in the first and second zones, and means for implementing a compatibility check to determine whether said image receiving tape and said thermal transfer ribbon are compatible, and to generate an incompatibility indication if the compatibility check fails.

Another aspect of the invention provides a printing apparatus having a first zone in which is received a supply of image receiving tape associated with an indicator identifying the nature of the image receiving tape and a second zone for receiving a supply of thermal transfer ribbon, means for identifying the nature of the image receiving tape from said indicator, and for identifying the nature of any thermal transfer ribbon located in the second zone, and means for implementing a compatibility check to determine whether said image receiving tape and any said thermal transfer ribbon are compatible, and to generate an incompatibility indication if the compatibility check fails.

Another aspect of the invention provides a method of operating a printing apparatus, the method comprising: reading an identifier from a supply of image receiving tape located in a first zone of the printing apparatus; checking in a second zone of the printing apparatus whether a supply of thermal transfer ribbon is present, and if it is present reading an identifier from said supply of thermal transfer ribbon, implementing a compatibility check to determine whether said image receiving tape and said thermal transfer ribbon are compatible, and generating an incompatibility indication if the compatibility check fails.

The nature of the image receiving tape and the thermal transfer ribbon can be respectively indicated by indicators carried by the supplies. The identifying means can operate remotely or by way of physical contact, and can be implemented optically, electronically or magnetically. In a preferred embodiment however the indicators carried by the supplies are embodied in RF tags, and the identifying means is an RF reader.

The use of an RF tag on the consumable has a number of advantages, for example where the consumable is a tape supply itself, because an RF tag can be implemented in the tape itself, without the need for a holder or cassette casing.

Because the link is contactless, there is no risk of information loss due to poor electrical contacts. Moreover, an RF tag is passive, in that it does not require an onboard power supply. The reader does not need to be located in a particularly precise location in the printing apparatus, and, as described in the following, can read more than one tag. An RF tag is robust and durable.

The supply of image receiving tape can be provided by itself (for example wound on a paper core), on a tape holder or in a cassette casing. The term "consumable" is used herein to denote each of these three possibilities.

In addition to identifying the nature of the image receiving tape and thermal transfer ribbon to allow their compatibility to be assessed, an RF tag can also hold parameter information identifying other parameters for controlling operation of the printing apparatus.

The printing apparatus can comprise a display which is adapted to display information relating to the detected nature of the image receiving tape and/or thermal transfer ribbon, together with said parameter information when present. The display can also display a message to a user, e.g. an error message or prompt, when the incompatibility indication is generated. The printing apparatus can also include a cutting system arranged to cut off a portion of the image receiving tape after printing to produce a label.

Other objects, features, and advantages of the present invention will become apparent from the following detailed description, the accompanying drawings, and the appended claims.

BRIEF DESCRIPTION OF THE DRAWINGS

For a better understanding of the present invention and to show how the same may be carried into effect, reference will now be made by way of example to the accompanying drawings, in which.

DETAILED DESCRIPTION OF THE ILLUSTRATED EMBODIMENTS

Figure 1:
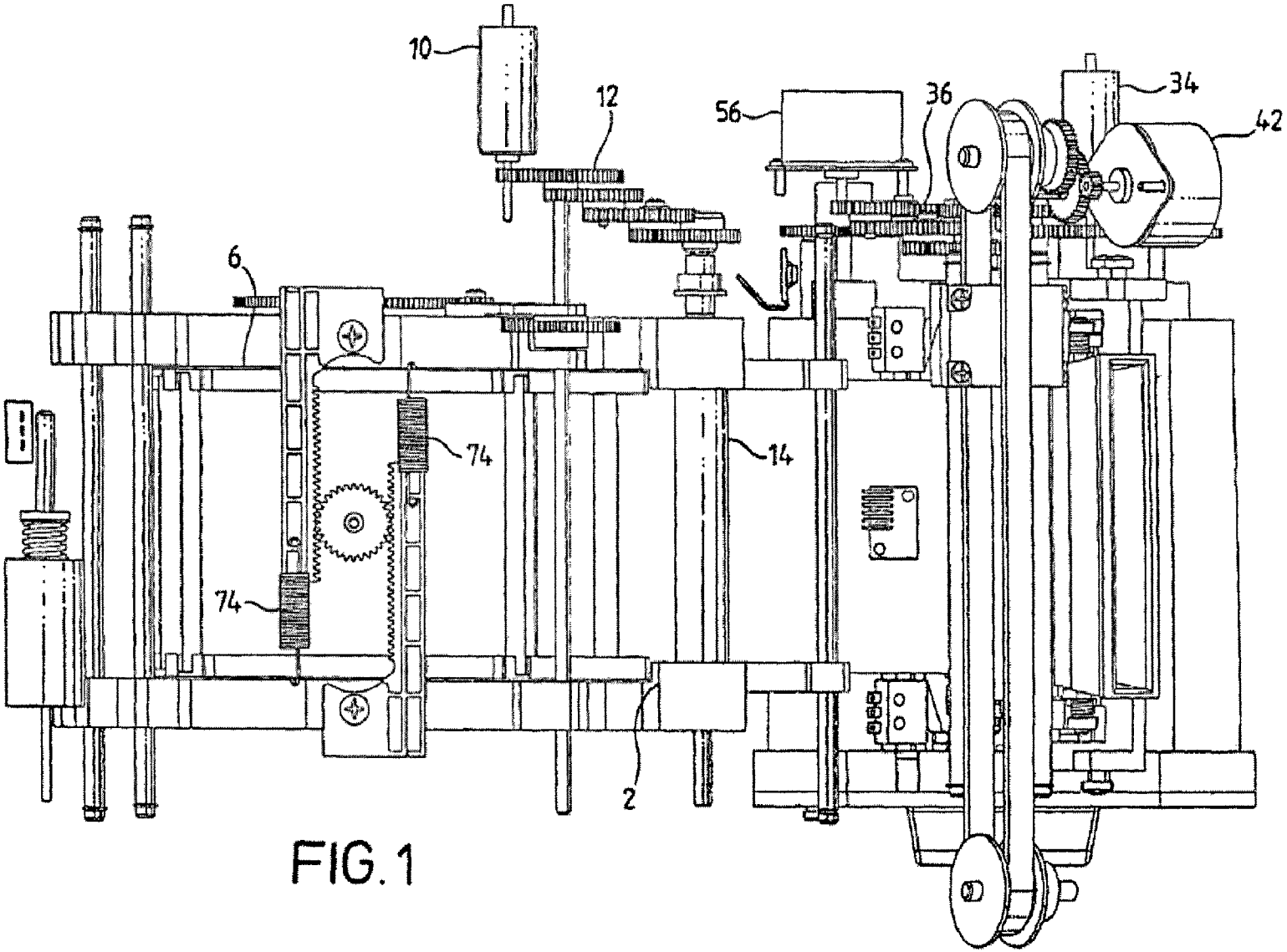
FIG. 1 is a plan view of the mechanical arrangement of a printing apparatus.
Figure 2:
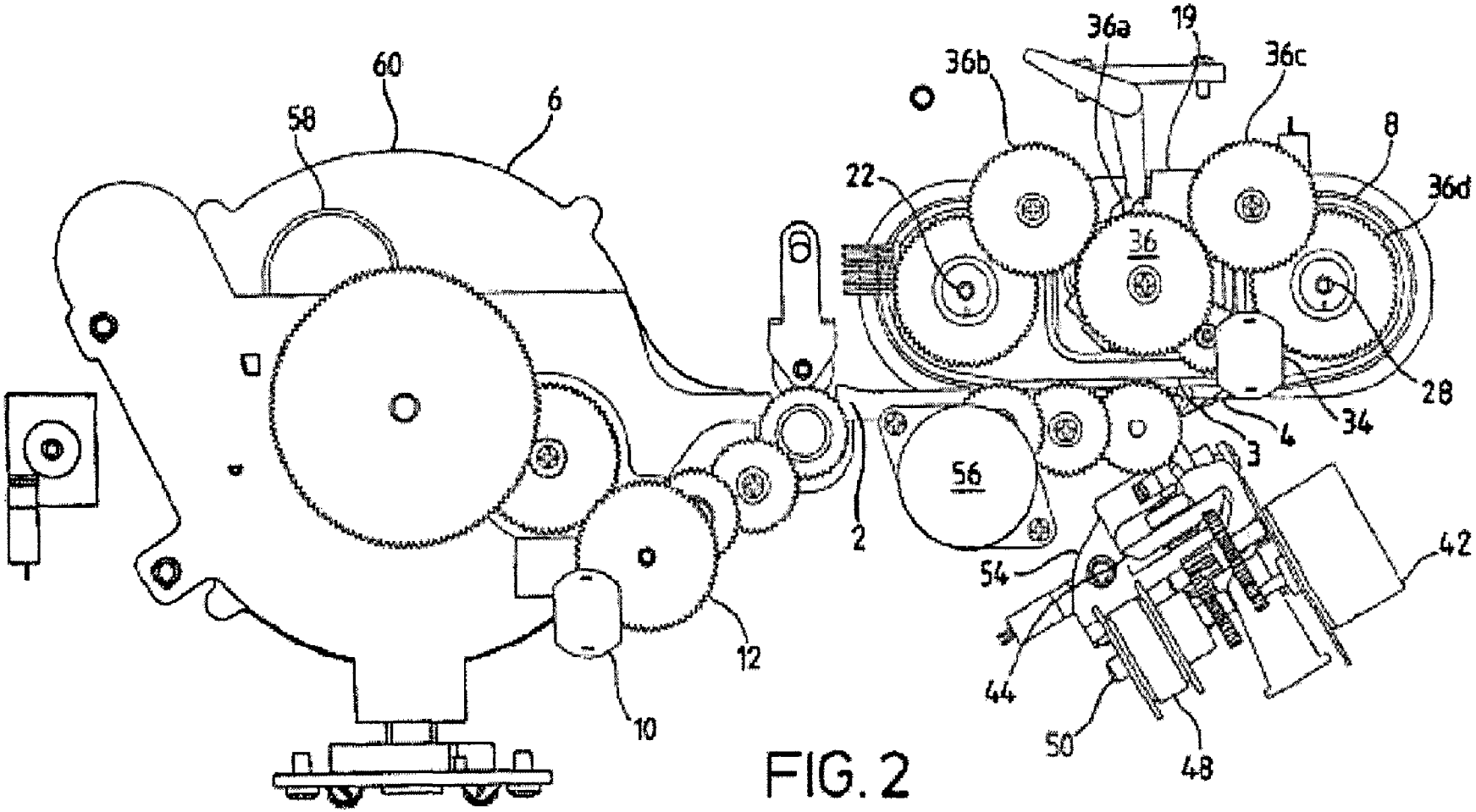
FIG. 2 is a side view of the mechanical arrangement of the printing apparatus.
Figure 3:
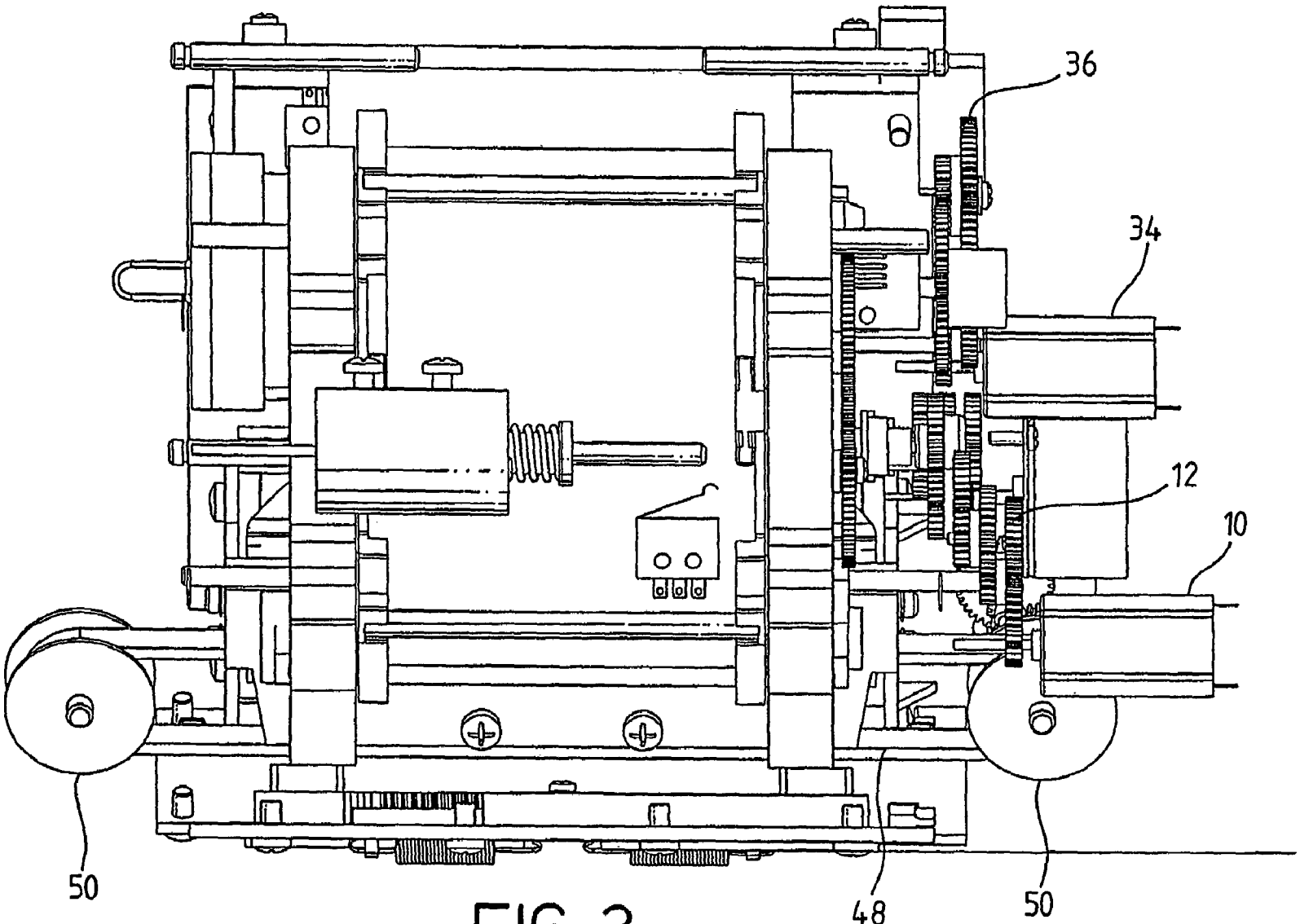
FIG. 3 is a front view of the mechanical arrangement of the printing apparatus.
Figure 4:
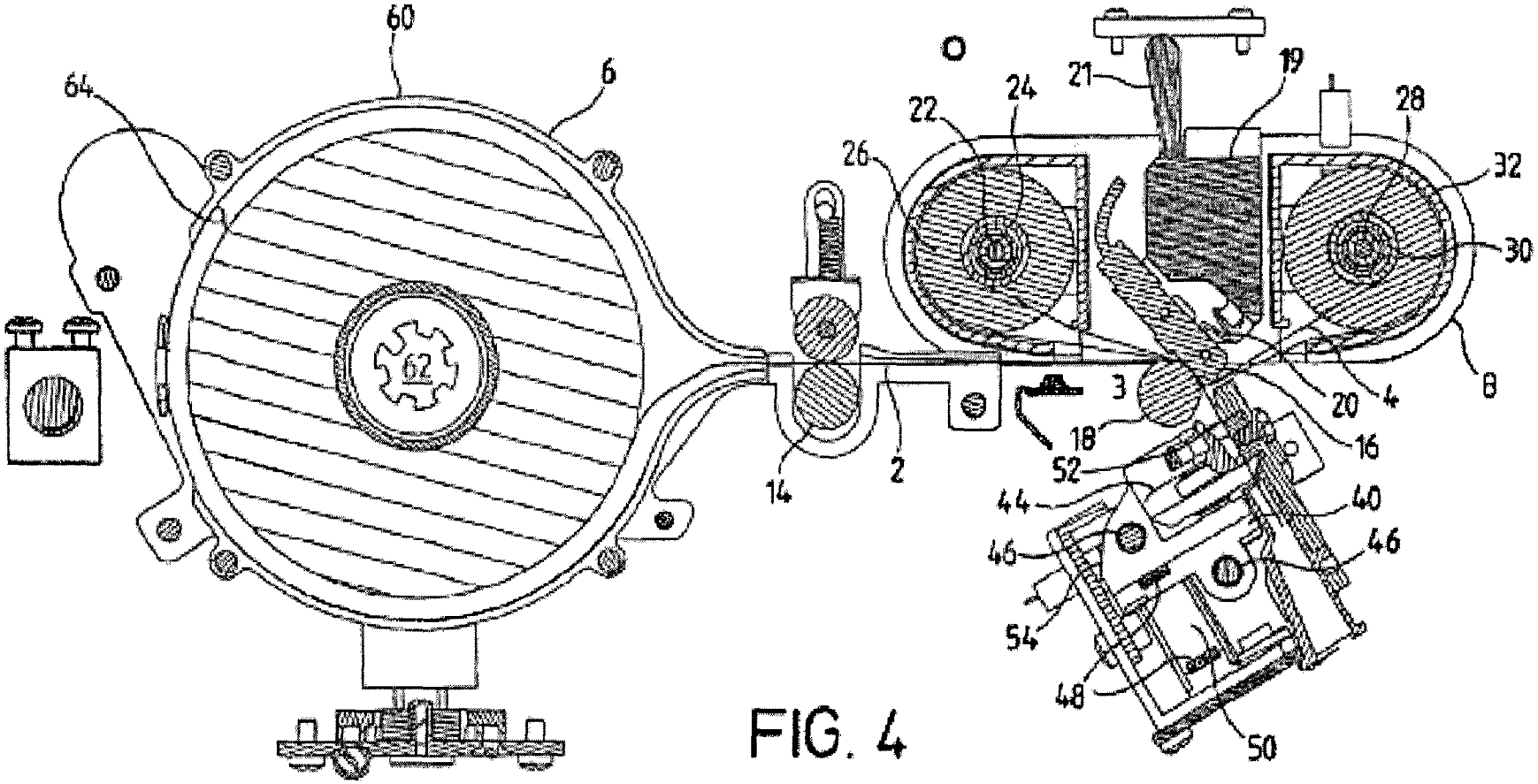
FIG. 4 is a cross-sectional view of the mechanical arrangement of the printing apparatus taken along line AA of FIG. 1.
Figure 4A:
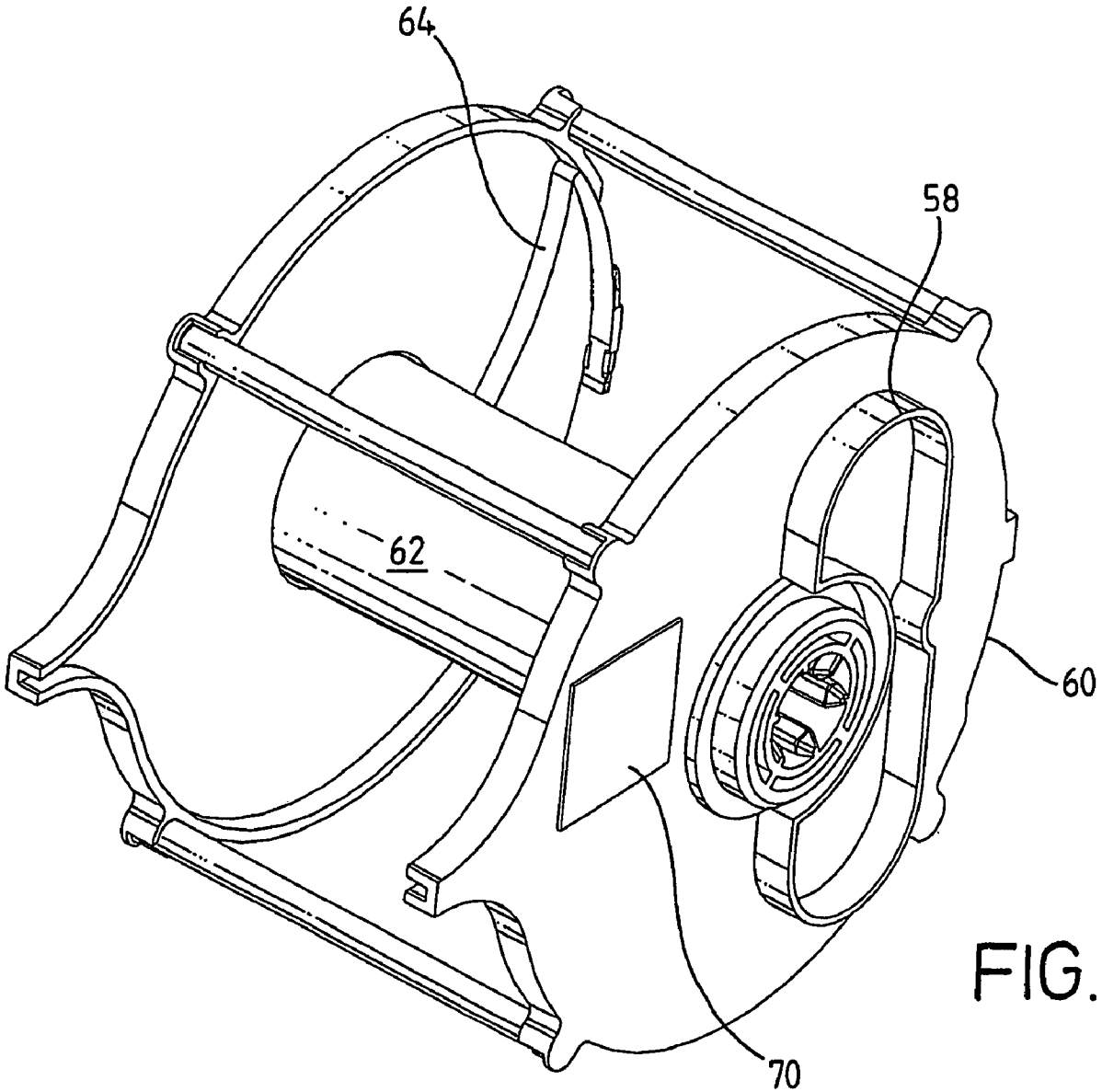
FIGS. 4A and 4B are perspective views from different angles of a tape holder.
Figure 4B:
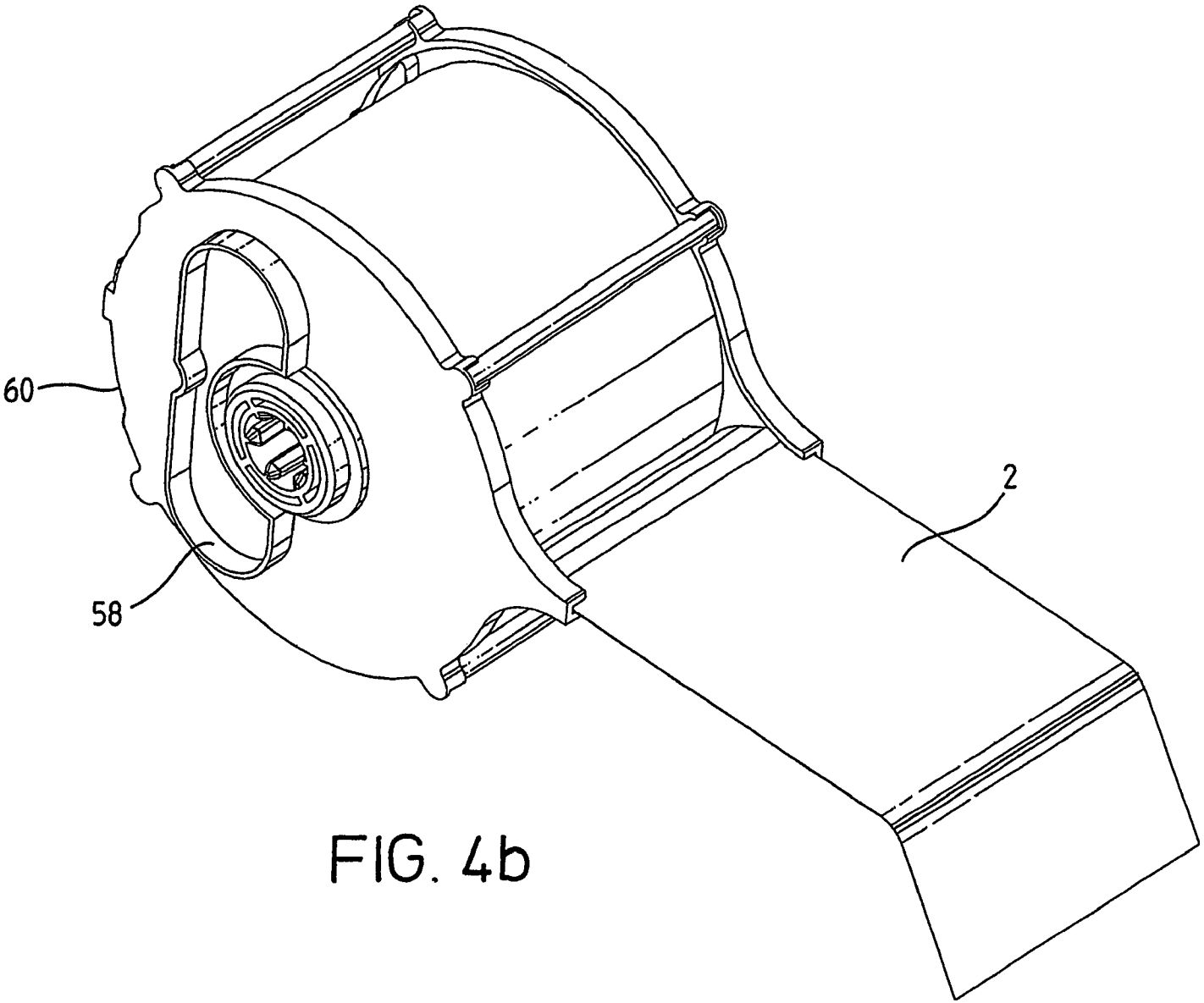

The mechanical arrangement of the printing apparatus will now be described with reference to FIGS. 1 to 4. A label substrate comprises a tape 2 onto which images can be printed by a printing apparatus into which the label substrate is inserted. The tape 2 is housed on a tape holder 6, the details of which can most clearly be seen from FIGS. 4, 4*a* and 4*b*. The tape holder 6 comprises sides 60 and an inner spool 62 around which a supply of tape 2 is wound. The inner spool 62 may rotate within the tape holder 6 when tape is unwound. A spring clip 64 is attached to a flange on the tape holder and bears on the spool 62. The spring clip 64 prevents the tape from unwinding more than is required. An annular rib 58 is provided on each side of the tape holder 6 which allow it to be housed in a first receiving part 66 of the printing apparatus.

Figure 4C:
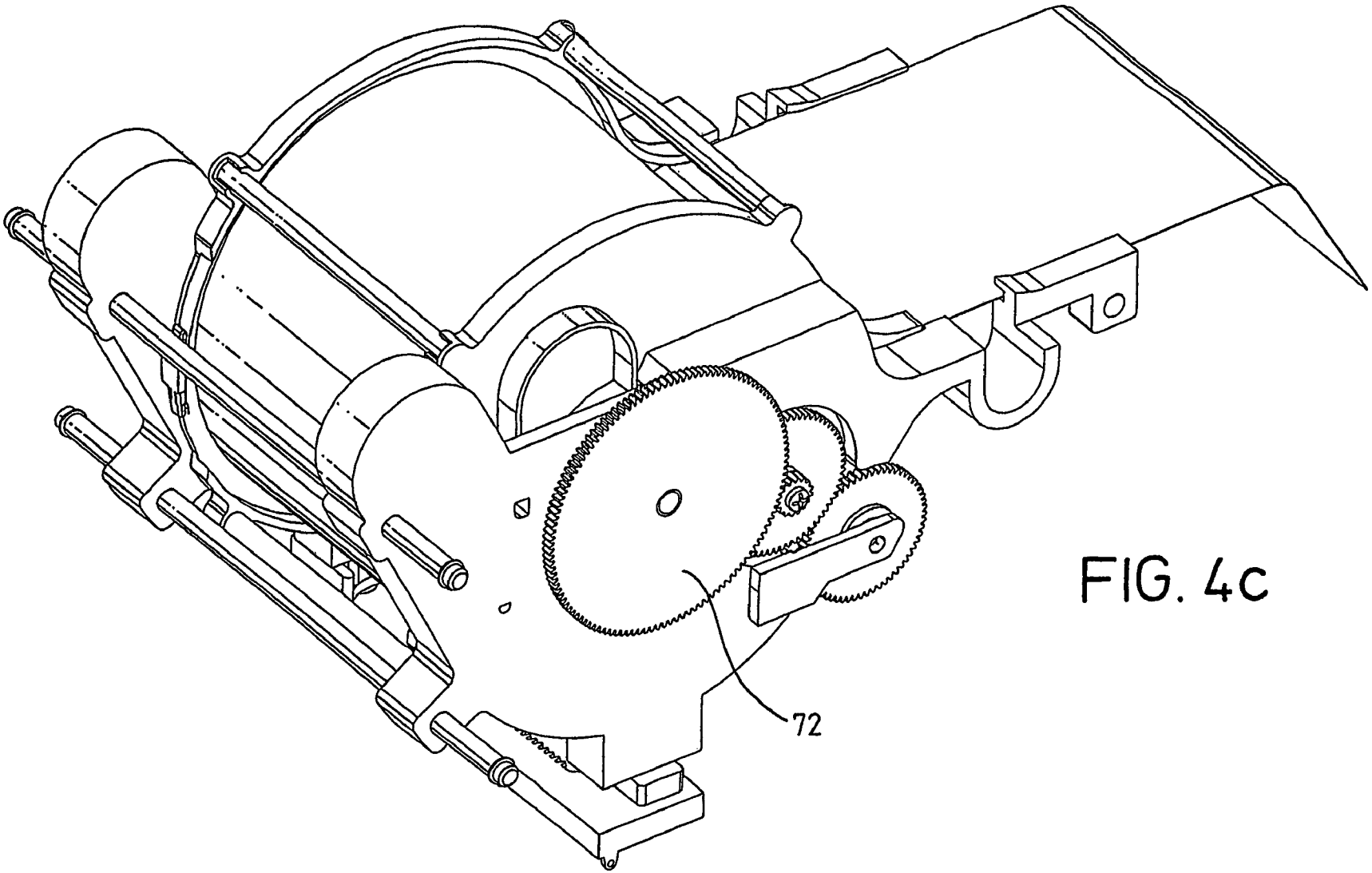
FIG. 4C is a perspective view of a tape holder housed in a receiving part of the printing apparatus and FIG. 4D is a perspective view of the receiving part of the printing apparatus without the tape holder installed.
Figure 4D:
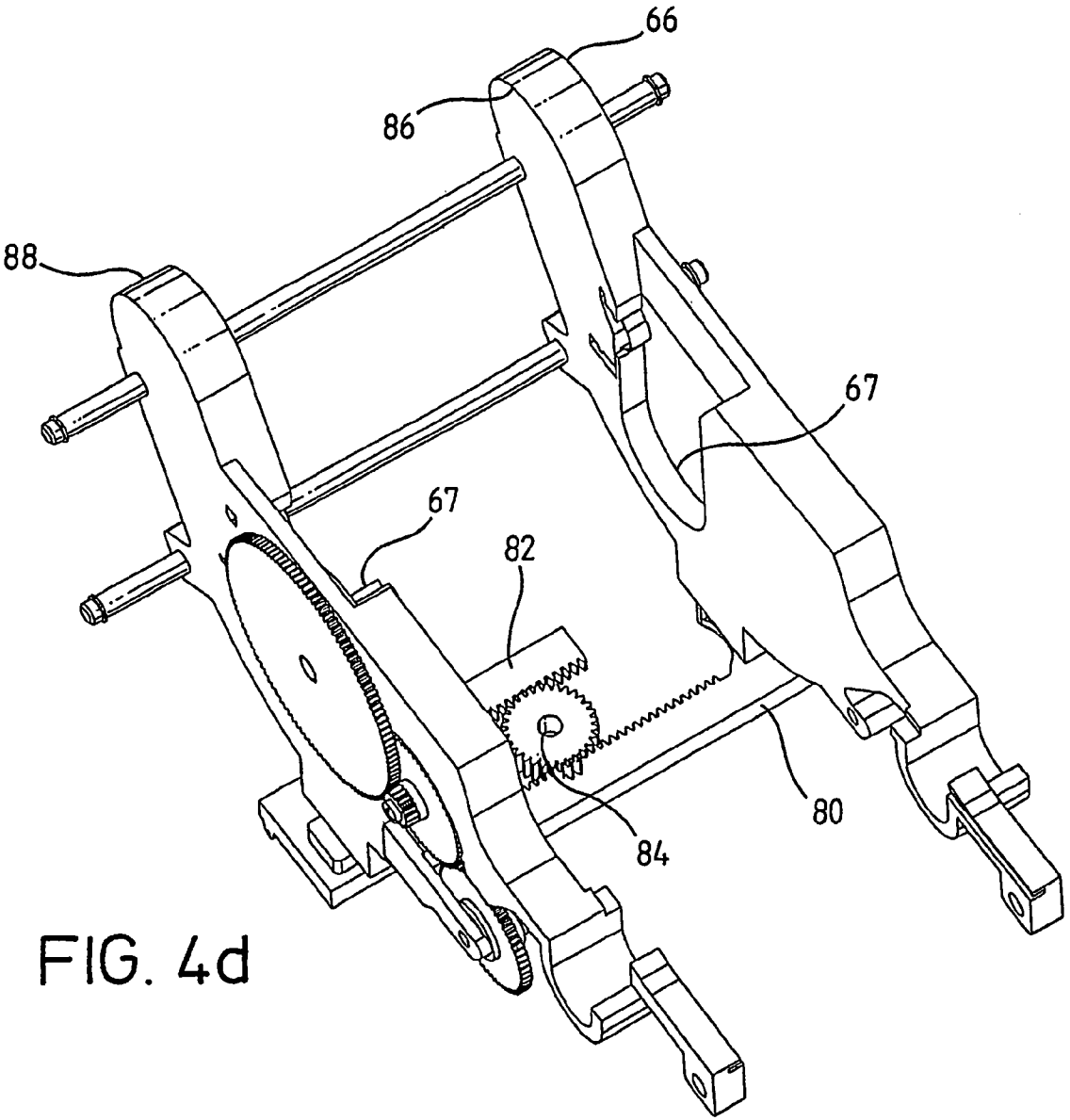

The first receiving part 66 is shown in FIG. 4D, and has side supports 86, 88 each having an inward facing recess 67 designed to accept the corresponding rib 58 of the tape holder 6. The first receiving part 66 is adjustable to accommodate different width holders as will now be explained. The supports 86 and 88 of the first receiving part 66 are connected to teethed arms 80 and 82. The teeth of teethed arms 80 and 82 engage with opposite edges of a cog 84. In this way any movement of one of the supports 86 or 88 is mirrored by the other support, so that each support is always an equal distance from a centre line A (shown in FIG. 1). This ensures that the tape will always be fed centrally to the print head, regardless of the width of the tape. The supports can be separated by a user to insert a holder, and then springs 74 (shown in FIG. 1) bring the supports together to grip the sides of the of the tape holder 6.

As shown in FIG. 4C, the receiving part 66 is provided with a gear chain 72 powered by a motor 10 (shown in FIG. 1) that drives the inner spool 62 of the tape holder in order to rewind the tape to allow the holder to be removed from the device.

The printing apparatus comprises a gear chain 12, powered by a motor 10, which drives the feed roller 14 which causes the tape from the tape holder 6 to move towards a print zone 3 of the printing apparatus. At the print zone, a print head 16 is biased against a platen roller 18 by a spring 20. The spring 20 is held within a print head mounting block 19.

Figure 8:
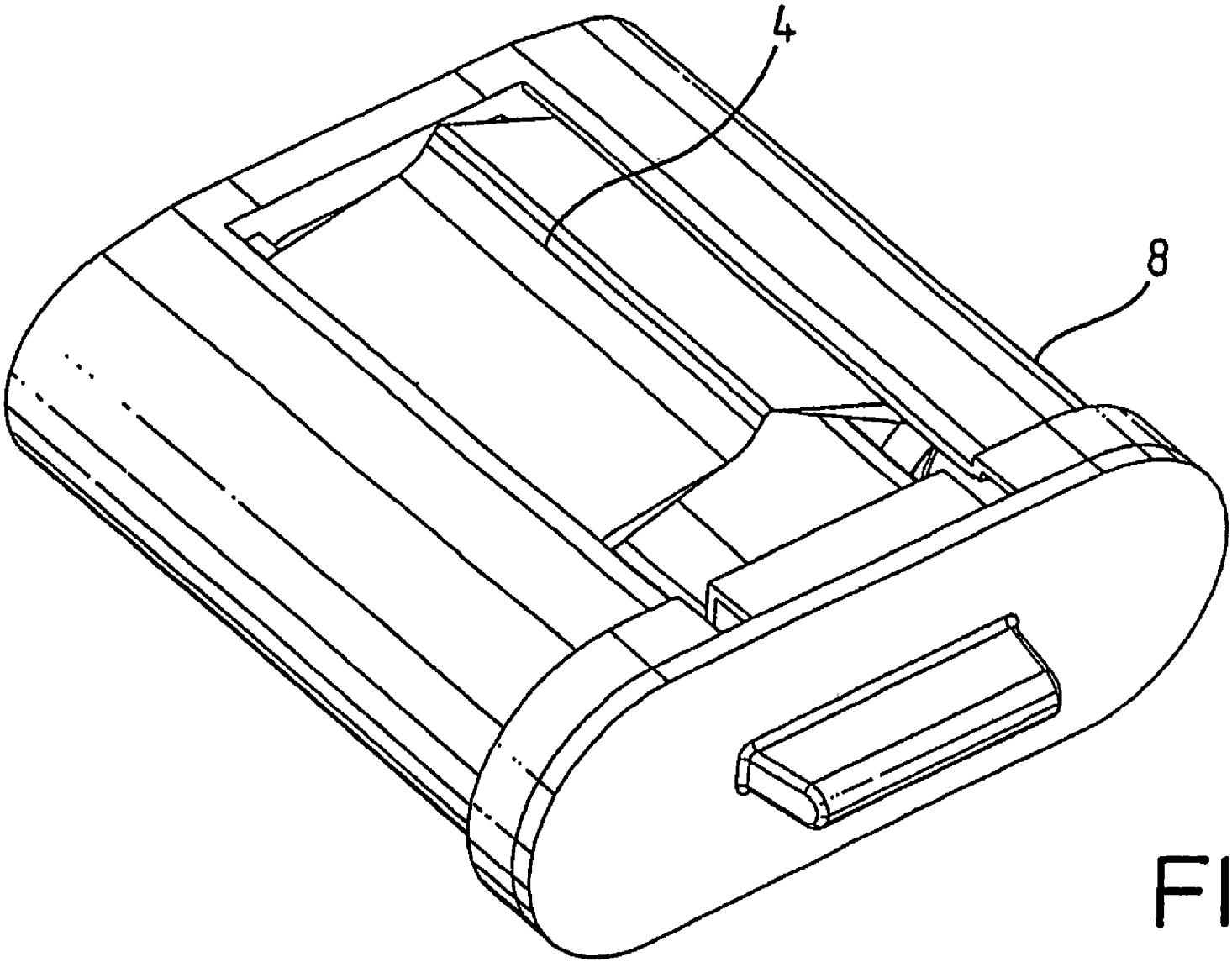
FIG. 8 is a perspective view of a ink ribbon cassette.

An ink ribbon cassette 8 (shown in FIG. 8) holds an ink ribbon 4 and is mounted in a second receiving part of the printing apparatus. It is mounted on shafts 22 and 28 of the printing apparatus. The mounting block 19 may be moved by means of an actuator 21 to separate the printhead and the platen to allow the ink ribbon cassette 8 to be removed from the printer. Unused ink ribbon 26 is stored on a supply reel 24 mounted on shaft 22. Used ink ribbon 32 is stored on a take-up reel 30 mounted on shaft 28. A motor 34 powers a gear chain 36. When the motor 34 is driving forwards, a first set of gears 36*c*, 36*d* drive the shaft 28 to pull the ink ribbon 4 in a forward direction from the supply reel 24 to the take-up reel 30, and a slipping clutch (not shown) disengages the shaft 22 so that it is not driven, but is free to turn. When the motor 34 drives in reverse, a second set of gears 36*a*, 36*b* drive the shaft 22 to pull the ink ribbon 4 in a reverse direction from the take-up reel to the supply reel, and a slipping clutch (not shown) disengages the shaft 28 so that it is not driven, but is free to turn.

The ink ribbon cassette 8 is located in the printing apparatus so that the ink ribbon 4 has a path which extends through the print zone 3, and in particular extends in overlap with the tape 2 between the printhead 16 and the platen 18. The platen 18 is driven by a platen motor 56, to drive the tape through the print zone.

A cutting apparatus 40 is located downstream of the print zone 3. The cutting apparatus comprises a circular cutting blade or cutting wheel 44 mounted on a cutter holder 54. The cutting blade 44 cuts the tape 2 against an anvil 52. A cutter motor 42 drives the cutting wheel 44 from a rest position across the width of the tape. Once the cutting wheel 44 has traversed the entire width of the tape, the cutter motor 42 is reversed and drives the cutter holder 54 back to its rest position. The cutter holder 54 is slidably mounted on two sliders 46 which span the entire width of the tape 2. The cutter holder 54 is attached to a belt 48 which is supported by two rollers 50. One of the rollers 50 is driven by the cutter motor 42 to cause the cutter holder to move along the sliders 46.

The mechanical function of the printing apparatus will now be described. During printing, the tape feed motor 10 and the ink ribbon motor 34 are activated to drive the tape 2 and the ink ribbon 4 respectively past the printhead 16 at an equal speed. Once the tape reaches the print zone, it is picked up by the platen 18, driven by the platen motor 56. An image is transferred onto the image receiving tape 2 by virtue of activation (heating) of particular printhead elements to transfer ink from the ink ribbon 4 to the substrate 2 in a known manner. Images are printed on a column by column basis as the tape 2 is moved past the printhead 16. This printing technique is known per se and so is not described further herein.

When the printing on a label is finished, the platen motor 56 and the ink ribbon motor 34 continue to feed the tape and the ink ribbon a predetermined distance until the end of the label is at the required cutting position. The tape may then be cut by the cutting apparatus 40. Once cutting is complete, the tape 2 is reversed by reversing the platen motor 56 that drives the platen 18 in reverse until the tape 2 is in the correct position for printing the next label. Whilst the tape is reversed, the ink ribbon 4 is also reversed at the same speed by driving the ink ribbon motor 34 in reverse. This prevents the ink ribbon 4 rubbing against the tape 2 and becoming damaged.

Figure 9:
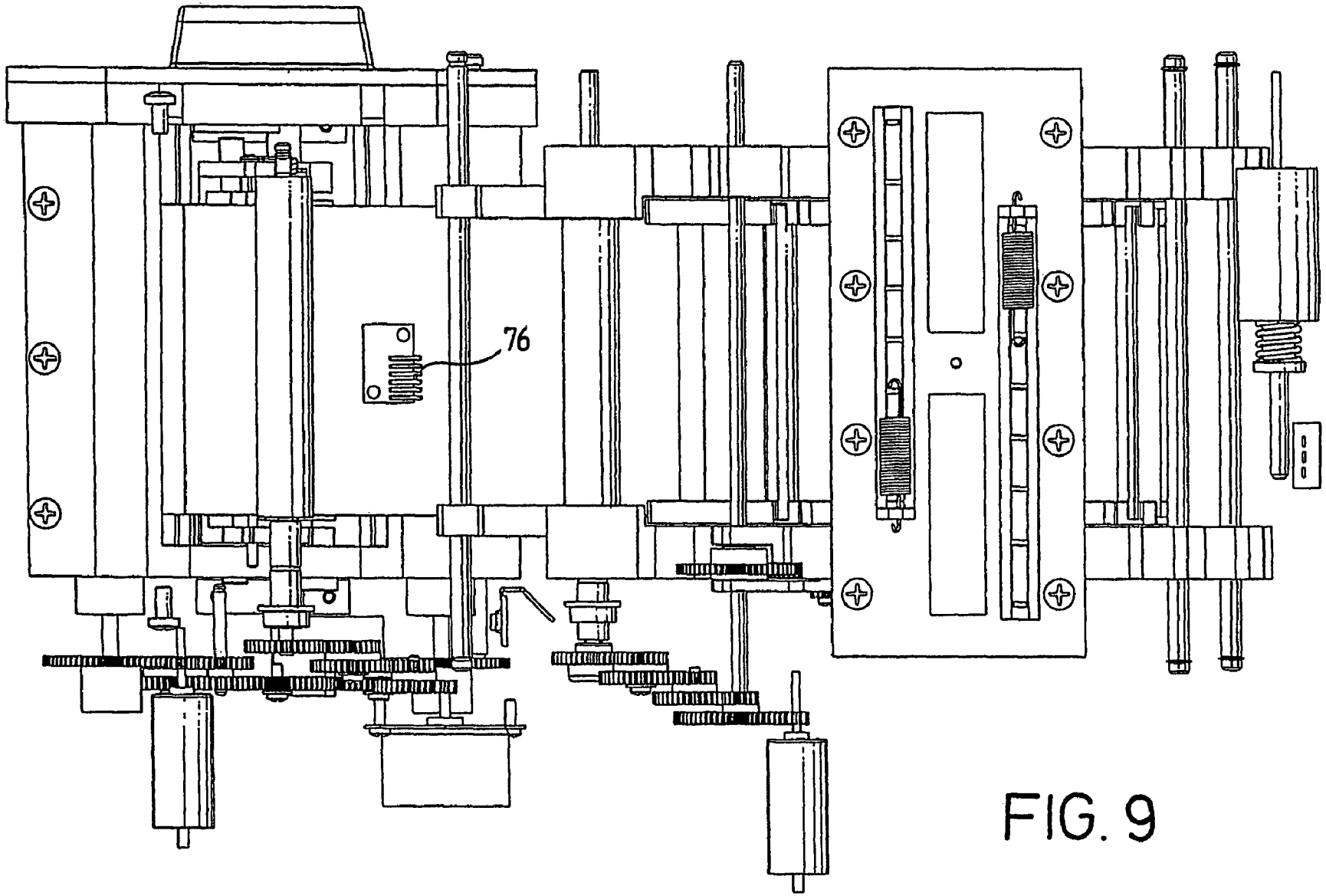
FIG. 9 is a plan view of the printing apparatus showing a photo-sensor.

A photo-sensor 76 shown in FIG. 9 is mounted on the frame of the printing apparatus and detects the presence of tape 2. This prevents the printer printing if there is no tape present in the printer.

Figure 5:
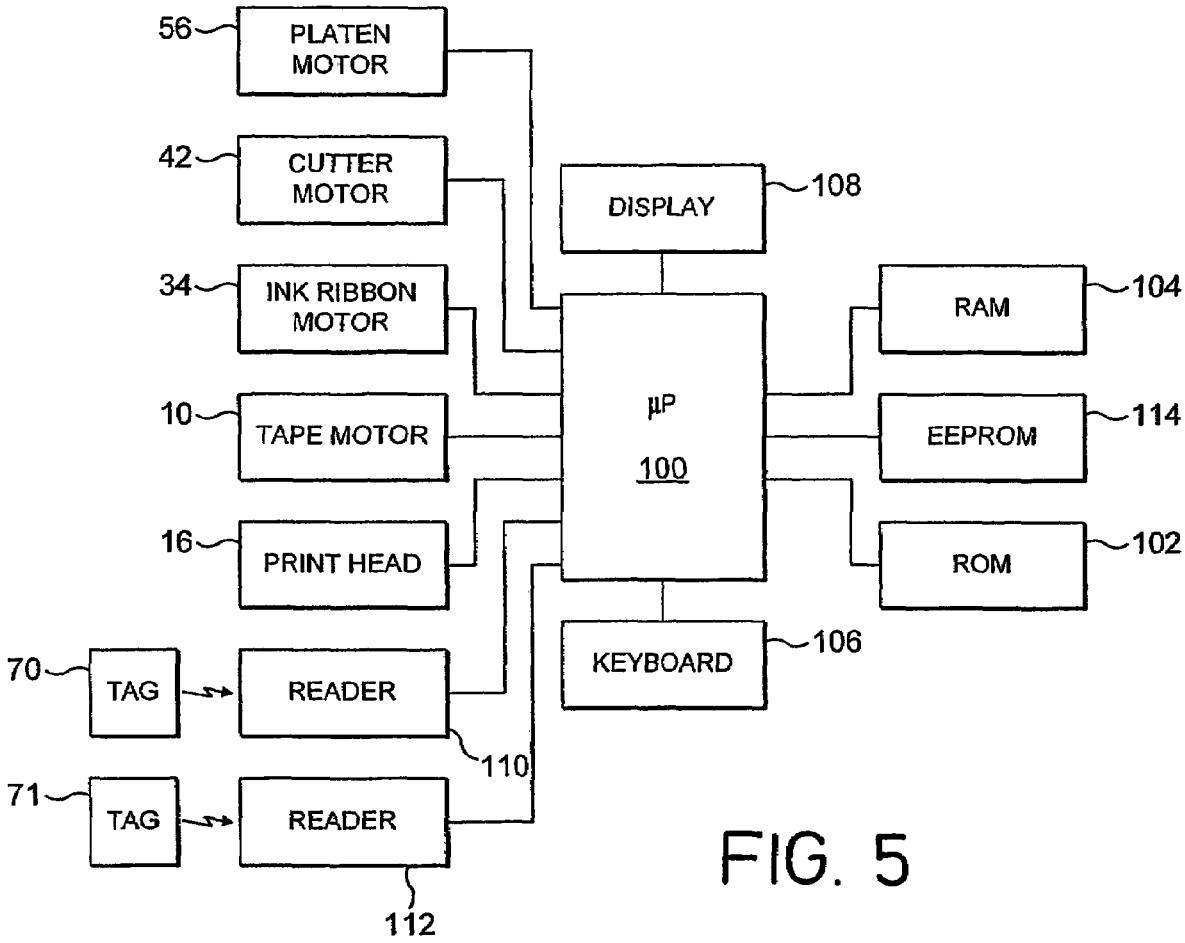
FIG. 5 is a schematic block diagram of control components of a printing apparatus.

FIG. 5 shows a schematic block diagram of the control components of the printing apparatus. A microprocessor 100 controls operation of the printing apparatus and is associated with a read only memory ROM 102, an electronically erasable programmable read only memory EEPROM 114 and a random access memory RAM 104. The printing apparatus includes a keyboard 106 for entering data (e.g. characters and symbols) and control commands for printing, and a display 108 for displaying to the user labels under edit, control commands, error messages, etc. The microprocessor 100 controls the printhead 16, tape drive motor 10, ink ribbon motor 34, cutter motor 42 and the platen motor 56.

The printing apparatus also includes first and second RF readers 110, 112. In principle, it would be possible to utilise a single reader if appropriately located, as will become clear below. Each reader can read an RF tag by receiving electromagnetic radio frequency signals from the tag, the signals incorporating information (encoded or not) in a manner known per se. The tape holder 6 carries one such RF tag 70 which identifies the nature of the image receiving tape, for example its width, type of material, colour etc. In addition, the ink ribbon cassette 8 has a second such RF tag 71 which indicates the nature of the ink ribbon 4 held in the ink ribbon cassette 8, for example its width, colour and material characteristics.

Figure 6:
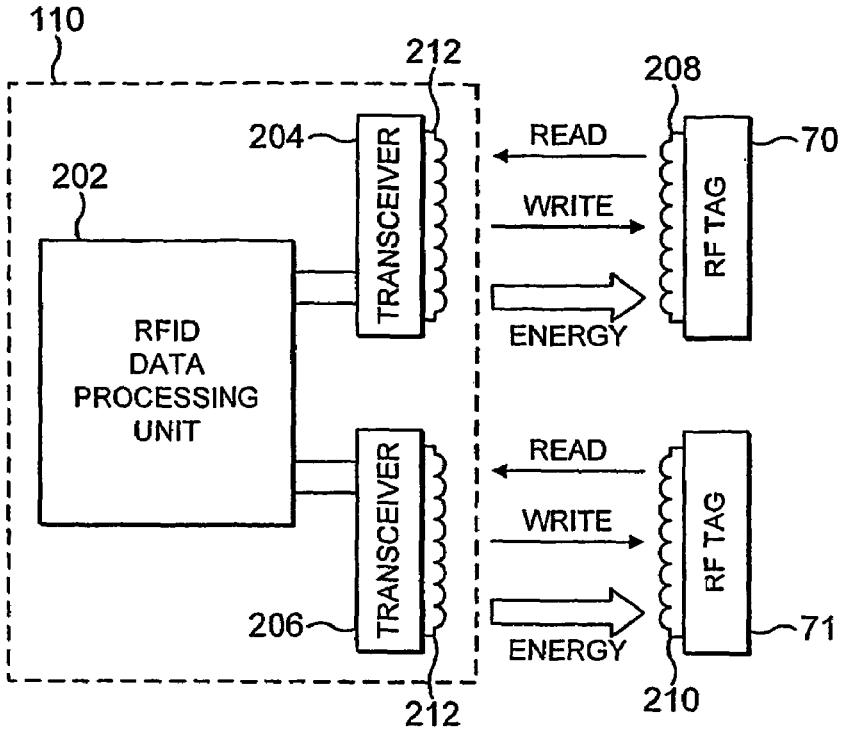
FIG. 6 is a block diagram of a tag reader.

FIG. 6 shows an embodiment in which the RF reader 110 is designed to read from both RF tags 70, 71, and there is no need for a second RF reader 112. The reader 110 takes the form of a RFID data processing unit 202 that controls transceivers 204 and 206. A transceiver 204 communicates via an RF coil 212 with a coil 208 implemented at the tag 70 mounted on the tape holder 6, by way of electromagnetic radio frequency waves. A transceiver 206 communicates via an RF coil with a coil 210 implemented at the tag 71 mounted on the ink ribbon cassette 8, thus via a contactless link. The signal communicated is encoded in a known way by modulating an RF carrier. The RF tags 70, 71 are passive devices that receive energy from the cassette reader 110 whenever they are accessed.

Where there is a single cassette reader, e.g. 110, it is located in the printer so that it can read the signal from the tags 70 and 71, even though they are not at the same location. The RFID DPU 202 switches between the transceivers 204, 206 depending on which tag is to be read.

Figure 7:
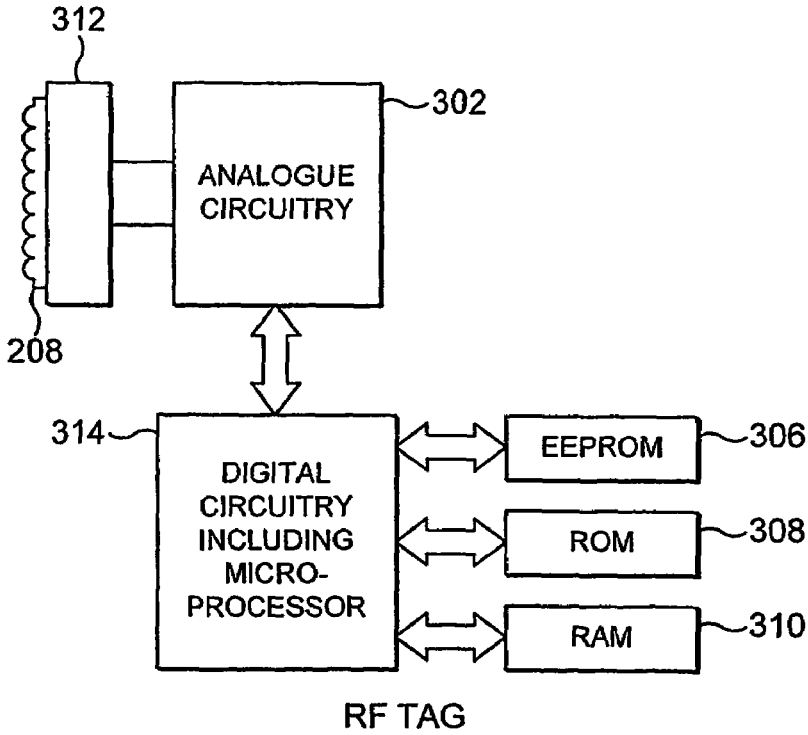
FIG. 7 is a block diagram of an RF tag.

FIG. 7 shows a schematic of the RF tag 70. RF tag 71 is designed to work in a similar fashion. An RF coil 208 is provided to receive control signals and power from the cassette reader 110. The signals are received by digital circuitry 304, which includes a microprocessor, via analogue circuitry 302. The digital circuitry 304 has access to EEPROM 306, ROM 308 and RAM 310. Information relating to the cassette is stored in the EEPROM and can be programmed during fabrication.

When a tape holder 6 is inserted into the printing apparatus the reader 110 reads the information from the tag 70 to identify the nature of the tape, and a corresponding signal is sent to the microprocessor 100. Assuming now that there is a separate reader for each RF tag, the second tag reader 112 similarly reads information identifying the nature of the ink ribbon held in the ink ribbon cassette 8 from its RF tag 71, and likewise sends a signal identifying that information to the microprocessor 100. As already mentioned, if properly located a single tag reader could read the information from both of the tags 70, 71. This information can be displayed on the display 108.

The microprocessor then carries out a compatibility check to determine whether the ink ribbon 4 is suitable for use with the image receiving tape 2 based on the information read from the tags 70 and 71. If the compatibility check is successful, the printer proceeds with a printing operation in the normal way. If the compatibility check is not successful an incompatibility indication is generated, and the printer will not print. In addition, an error message is displayed to a user on display 108.

Where the compatibility check is successful, the microprocessor also determines whether any particular printing regime is required for the ink ribbon/tape combination that it has identified. For example, the printhead strobing time, strobing scheme, energy levels, feed speed may all be affected by the particular combination.

Where the compatibility check fails, the microprocessor can force the display to prompt a user to correct the mistake. For example, if an ink ribbon cassette has been inserted with a roll of direct thermal printing tape, or with an incompatible tape roll, a prompt can be given to remove the ink ribbon cassette. Moreover, if a particular tape 2 is inserted, a prompt can be given to a user via the display 108 to insert an ink ribbon cassette with a given material code.

The compatibility check may be carried out on the basis of a compatibility matrix held in the ROM of the printing apparatus. The compatibility matrix defines each possible cassette/holder combination whether or not the combination is allowed and if so what printing regime is associated with it. The matrix could be updated by a user through a PC connection port provided on the printer.

It will be understood that the term "compatibility" used herein is used to denote whether a successful printing operation will be implemented with the particular combination of image receiving tape and ink ribbon inserted into the printing apparatus. For example, certain colours of ink ribbon may not readily transfer an image to certain colours of image receiving tape, a striking example being a black image receiving tape and a black ink ribbon. Thus, a colour compatibility check is important.

It is also important that the width of the ink ribbon matches the width of the image receiving tape. If the width of the ink ribbon is smaller than the width of the image receiving tape, then an image will not be printed across the full width of the image receiving tape. Therefore, a width compatibility check is important.

If a direct thermal tape is inserted into the printing apparatus, there is no need for an ink ribbon cassette, and indeed an ink ribbon cassette will foul operations. Therefore if a direct thermal tape is inserted, it is important to identify that there is no ink ribbon cassette before printing is commenced.

Still further, certain material characteristics of the image receiving tape may require certain material characteristics of the ink ribbon so that an image is properly transferred from one to the other, to achieve proper scratch and solvent resistance of the image on the tape.

While the above embodiment has been described with RF tags on the supplies and one or more RF reader in the printing apparatus, it will readily be appreciated that the identification means could be implemented in any suitable way, for example electronically, optically or magnetically, directly or remotely.

The foregoing exemplary embodiments have been provided solely to illustrate the structural and functional principles of the present invention, and is not intended to be limiting. To the contrary the present invention is intended to encompass all modifications, alterations, substitutions and equivalents within the spirit and scope of the following claims.

The invention claimed is:

1. A printing apparatus comprising:

a first zone for receiving a supply of image receiving tape and a second zone for receiving a supply of thermal transfer ribbon, means for identifying a nature of the supply of image receiving tape and the supply of thermal transfer ribbon located in the first and second zones, and means for implementing a compatibility check to determine whether said supply of image receiving tape and said supply of thermal transfer ribbon are compatible, and to generate an incompatibility indication if the compatibility check fails, wherein said incompatibility indication comprises a prompt for a user to insert an alternate supply of thermal transfer ribbon or an alternate supply of image receiving tape.

2. A printing apparatus comprising:

a first zone adapted to receive a supply of image receiving tape and a second zone adapted to receive a supply of thermal transfer ribbon, a reader adapted to receive information from the supply of image receiving tape and the supply of the thermal transfer ribbon to identify a nature of the supply of image receiving tape, and the supply of thermal transfer ribbon located in the first and second zones, and a controller adapted to implement a compatibility check to determine whether said supply of image receiving tape and any said supply of thermal transfer ribbon are compatible, and to generate an incompatibility indication if the compatibility check fails, wherein said incompatibility indication comprises a prompt for a user to insert an alternate supply of thermal transfer ribbon or an alternate supply of image receiving tape.

3. A printing apparatus according to claim 2, wherein the reader operates by remote detection of the supply of image receiving tape and the supply of thermal transfer ribbon.

4. A printing apparatus according to claim 3, wherein the reader operates optically, magnetically or electrically.

5. A printing apparatus according to claim 2, comprising a display adapted to display information relating to the detected nature of the supply of image receiving tape and the supply of thermal transfer ribbon.

6. A printing apparatus according to claim 5, wherein said display is adapted to display a message to a user in the event of the incompatibility check being implemented.

7. A printing apparatus according to claim 3, wherein each of the supply of image receiving tape and the supply of thermal transfer ribbon is associated with an RF tag holding information identifying the nature of the supply, the reader comprising one or more RF readers for reading information from the or each RF tag via a contactless link.

8. A printing apparatus according to claim 7, wherein a single reader comprises first and second transceivers for communicating respectively with RF tags on each supply.

9. A printing apparatus according to claim 2, wherein the controller comprises a processor with a memory holding a compatibility matrix identifying possible combinations of supplies of thermal transfer ribbon and supplies of image receiving tape, each combination being associated with an indication as to whether or not that combination is a compatible combination.

10. A printing apparatus according to claim 9, wherein the matrix is updateable by a user.

11. A printing apparatus according to claim 9, wherein the memory holds with each combination a printing regime associated with that combination, the printing regime being usable for controlling operation of the printing apparatus when that combination is identified.

12. A method of operating a printing apparatus, the method composing:

reading an identifier from a supply of image receiving tape located in a first zone of the printing apparatus;

reading an identifier from a supply of thermal transfer ribbon located in a second zone of the printing apparatus, implementing a compatibility check to determine whether said supply of image receiving tape and said supply of thermal transfer ribbon are compatible, and generating an incompatibility indication if the compatibility check fails, wherein said incompatibility indication comprises a prompt for a user to insert an alternate supply of thermal transfer ribbon or an alternate supply of image receiving tape.

13. A method according to claim 12, wherein the acts of reading an identifier from the supply of image receiving tape and reading an identifier from said supply of thermal transfer ribbon is carried out using a single reader.

14. A method according to claim 12, wherein the act of implementing a compatibility check comprises checking the identified combination of the supply of image receiving tape and supply of thermal transfer ribbon with a plurality of possible combinations held in a compatibility matrix, each combination being associated with an indication as to whether or not that combination is a compatible combination.

15. A method according to claim 14, further comprising printing an image on the image receiving tape using a printing regime associated with the identified combination, if no incompatibility indication has been generated.

16. A printing apparatus comprising:

a first zone adapted to receive a supply of image receiving tape and a second zone adapted to receive a supply of thermal transfer ribbon, a reader adapted to receive information from the supply of image receiving tape and the supply of the thermal transfer ribbon to identify a nature of the supply of image receiving tape and the supply of thermal transfer ribbon, and a controller adapted to implement a compatibility check to determine whether said supply of image receiving tape and said supply of thermal transfer ribbon are compatible, and to generate an incompatibility indication if the compatibility check fails, wherein said reader operates by remote detection of said supply of image receiving tape and the supply of thermal transfer ribbon.

17. A printing apparatus according to claim 16, wherein each of the supply of image receiving tape and the supply of thermal transfer ribbon is associated with an RF tag holding information identifying the nature of the supply, the reader comprising an RF reader with first and second transceivers.

18. A printing apparatus according to claim 16, wherein the reader operates optically.

19. A printing apparatus according to claim 16, wherein the reader operates magnetically.

20. A printing apparatus according to claim 16, wherein the reader operates electrically.

21. A printing apparatus comprising:

a first zone adapted to receive a supply of image receiving tape and a second zone adapted to receive a supply of thermal transfer ribbon, an identifying device adapted to identify a nature of the supply of image receiving tape and the supply of thermal transfer ribbon located in the first and second zones, a processor, and a memory storing a compatibility matrix identifying possible combinations of supplies of thermal transfer ribbon and supplies of image receiving tape, each combination being associated with an indication as to whether or not that combination is a compatible combination, the processor being operable to determine whether the identified supply of image receiving tape and the identified supply of thermal transfer ribbon are a compatible combination using the compatibility matrix and to generate an incompatibility indication if the compatibility check fails.

22. A printing apparatus according to claim 21, wherein the memory holds with each combination a printing regime associated with that combination, the printing regime being usable for the controlling operation of the printing apparatus when that combination is identified.

23. A printing apparatus according to claim 21, wherein the matrix is updateable by a user.

24. A printing apparatus according to claim 21, wherein the memory holds with each combination a printing regime associated with that combination, the printing regime being usable for controlling operation of the printing apparatus when that combination is identified.

25. A printing apparatus comprising:

a first zone adapted to receive a supply of image receiving tape and a second zone adapted to receive a supply of thermal transfer ribbon, a reader adapted to receive information from the supply of image receiving tape to identify a nature of the supply of image receiving tape, an identifying unit adapted to determine if a supply of thermal transfer ribbon is present in the second zone, and a controller adapted to generate an incompatibility indication if the supply of image receiving tape comprises direct thermal tape and a supply of thermal transfer ribbon is present in the second zone.

26. A printing apparatus comprising:

a first zone adapted to receive a supply of image receiving tape and a second zone adapted to receive a supply of thermal transfer ribbon, a reader adapted to receive information from the supply of image receiving tape and the supply of the thermal transfer ribbon to identify a nature of the supply of image receiving tape and the supply of thermal transfer ribbon, and a controller adapted to implement a compatibility check to determine whether said supply of image receiving tape and said supply of thermal transfer ribbon are compatible, and to generate an incompatibility indication if the compatibility check fails, wherein said compatibility check comprises at least one of a color compatibility check and a material compatibility check.

27. A method of operating a printing apparatus, the method comprising:

reading an identifier from a supply of image receiving tape located in a first zone of the printing apparatus;

reading an identifier from a supply of thermal transfer ribbon located in a second zone, implementing a compatibility check to determine whether said supply of image receiving tape and said supply of thermal transfer ribbon are compatible using a compatibility matrix, said compatibility matrix being stored in memory and identifying possible combinations of supplies of thermal transfer ribbon and supplies of image receiving tape, each combination being associated with an indication as to whether or not that combination is a compatible combination, and generating an incompatibility indication if the compatibility check fails.

28. A method of operating a printing apparatus, the method comprising:

reading an identifier from a supply of image receiving tape located in a first zone of the printing apparatus;

checking in a second zone of the printing apparatus whether a supply of thermal transfer ribbon is present, and generating an incompatibility indication if the supply of image receiving tape comprises direct thermal tape and a supply of thermal transfer ribbon is present in the second zone.

29. A method of operating a printing apparatus, the method comprising:

reading an identifier from a supply of image receiving tape located in a first zone of the printing apparatus;

reading an identifier from a supply of thermal transfer ribbon located in a second zone of the printing apparatus, implementing a compatibility check to determine whether said supply of image receiving tape and said supply of thermal transfer ribbon are compatible, and generating an incompatibility indication if the compatibility check fails, wherein said compatibility check comprises at least one of a color compatibility check and a material compatibility check.

* * * * *